United States Patent [19]

Sharpe

[11] Patent Number: 4,927,497

[45] Date of Patent: May 22, 1990

[54] METHOD OF PREVENTING CELLULOSIC WEB DEGRADATION USING AN AMINE VAPOR

[76] Inventor: Hillary M. Sharpe, 46 Selvage Lane, Mill Hill, London, NW7 3SP, United Kingdom

[21] Appl. No.: 227,919

[22] Filed: Aug. 3, 1988

[30] Foreign Application Priority Data

Aug. 4, 1987 [GB] United Kingdom ..... 8718422

[51] Int. Cl.[5] ..... D21D 3/00; D21H 5/22

[52] U.S. Cl. ..... 162/160; 422/9; 427/395; 427/398.4; 55/74

[58] Field of Search ..... 55/74; 422/9, 10; 427/248.1, 395, 398.4; 162/63, 160

[56] References Cited

U.S. PATENT DOCUMENTS 3,703,353 11/1972 Kusterer, Jr. et al. ..... 427/395

FOREIGN PATENT DOCUMENTS 1129648 10/1968 United Kingdom .
2156830 10/1985 United Kingdom .

OTHER PUBLICATIONS

Ede, et al., Sulphur Dioxide and Vapour Phase Deacidification, London, Sep. 1968, pp. 37–40.
The New V.P.D. Envelope Method Leaflet No. 2, B. G. Robertson Laboratories Limited, London, before Aug. 4, 1987.
Kathpalia, Deterioriation and Conservation of Paper: Part IV Neutralization, Oct. 1962, pp. 245–251.

*Primary Examiner*—Steve Alvo
*Attorney, Agent, or Firm*—Bernard, Rothwell & Brown

[57] ABSTRACT

A method of combatting cellulosic fibre web degradation which method comprises permeating a stack of cellulosic fibre webs with an amine vapor, characterized in that said method comprises disposing an amine-immobilizing agent to immobilize amine vapor which has passed through at least part of said stack. Thus for example a book deteriorating with age can be treated by putting a charcoal containing sachet inside the front and back covers and by interleaving the rest of the book, every 20 to 50 pages or so, with sachets containing cyclohexylamine carbonate.

12 Claims, No Drawings

METHOD OF PREVENTING CELLULOSIC WEB DEGRADATION USING AN AMINE VAPOR

The present invention relates to improvements in and relating to the vapour phase deacidification of cellulosic fibre webs, and in particular to the deacidification of the pages of books or of other documents comprising such webs.

Cellulosic fibre webs, such as paper sheets for example, gradually degrade and become brittle and the prevention of stock deterioration is a major problem for archivists, librarians and the like.

It is considered that strong acids, such as sulphuric and hydrochloric acids, present in the cellulosic webs are the agents primarily responsible for their premature degradation. Aluminium sulphate is commonly used as a sizing agent in the manufacture of paper and this leads to the paper eventually becoming acidic. Another possible cause of the acidity is the effect of atmospheric contamination. Thus, sulphur dioxide, even in the small concentration at which it is generally present in the air, can react with atmospheric oxygen to generate sulphuric acid. This acid generation is exacerbated by metal species, such as iron, manganese or copper species, which may often be present in the cellulosic webs in catalytic quantities.

It is therefore widely accepted that to prevent further degradation books and other cellulosic web based documents, such as maps, magazines, loose paper sheets and the like, should be deacidified and then maintained in the range of from about pH 5 to about pH 8.

Conventional_ deacidification procedures however are time consuming, laborious and above all expensive involving as they do unbinding, soaking the pages in liquid alkaline solutions, drying and re-binding. Indeed, deacidification in this manner of all the books in which deterioration due to acidity is occurring is quite simply beyond the financial resources of many if not most libraries and archives.

An alternative approach to the conventional liquid phase deacidification procedure was suggested by Langwell in GB-A-1129648. Langwell's technique involved causing a dry gaseous alkali to penetrate the cellulosic webs being treated, for example by placing sheets impregnated with an amine salt or sachets containing an amine salt between the pages of a book or within a folder containing loose paper sheets, the book or folder then being maintained within a closed environment to allow the amine vapour to diffuse through the cellulosic webs. In this vapour phase deacidification procedure it was found that amine vapour diffused quite rapidly through the pages of a closed book and rather more slowly from the centre of the book towards the edges. It was thus found that vapour phase deacidification could readily be performed by interleaving a book with amine salt-containing sachets or amine salt-impregnated papers, the impregnated papers or sachets being inserted at intervals or about 50 pages.

However, vapour phase deacidification, although relatively simple, rapid and inexpensive to perform, still had attendant drawbacks. Thus, as complete deacidification is required, the process inevitably involves volatilization of a greater quantity of amine than is required to neutralize the unknown quantity of acid that is present in the webs being treated. The excess amine vapour will escape to the atmosphere if the deacidification is not performed in a sealed container and, although it is not believed to be harmful Langwell's preferred amine, cyclohexylamine, has a distinct ammoniacal smell and at high concentrations can irritate the respiratory passages. A more serious problem with vapour phase deacidification has been that the excess amine vapour tends to react with the materials of the bindings to cause deterioration and degradation thereof. Since deacidification is particularly necessary for old books whose bindings may already be frail or worn and since rebinding is laborious, time-consuming and expensive, this drawback is particularly serious.

We have now found that the drawbacks of vapour phase deacidification discussed above may be avoided or reduced by the use in the deacidification procedure of an amine vapour immobilizing agent, such as charcoal.

Viewed from one aspect therefore the invention provides a method of combatting cellulosic fibre web degradation which method comprises permeating a stack of cellulosic fibre webs with an amine vapour, characterised in that said method comprises disposing an amine-immobilizing agent to immobilize amine vapour which has passed through at least part of said stack.

The amine vapour which effects deacidification is preferably the volatilization product of an amine salt disposed between webs within the stack being treated. Suitable amine salts include those mentioned in GB-A-1129648, that is non-deliquescent salts formed from normally liquid monoamines having dissociation constants greater than $1.75\times10^{-5}$ and from acids having dissociation constants not greater than $2.1\times10^{-4}$, particularly preferably cyclohexylamine, diisopropylamine, di-n-butylamine and piperidine salts or mixtures thereof, and especially preferably cyclohexylamine carbonate (CHC).

The amine salt is preferably contained within a porous container, for example a sachet of perforated or otherwise porous material such as kraft paper or tea bag paper; alternatively it may be impregnated into a porous substrate, for example a paper sheet, cotton wool or lint. This facilitates the disposition of the amine vapour source within the stack being treated, as such sachets or impregnated sheets may readily be inserted at intervals throughout the stack. Generally, such interleaving will be done at intervals of 10–150, preferably 20–50 webs.

To ensure adequately uniform amine vapour release, where amine salt-containing sachets are being used they are preferably compartmented to prevent the contents from accumulating at one end only. Thus sachets with two, three or four compartments are particularly preferred. The quantity of amine salt within each sachet or sheet and the overall dimensions of the sachet or sheet will of course depend upon the nature of the amine salt and on the size of the web being treated. Typically however sachets and impregnated sheets would have an amine salt content of 300–1000 g/m$^2$, and for most common book sizes sachets containing 6 g of amine salt, for example 3 g in each of two compartments, will be adequate.

In use, the amine salt within the sachet or impregnated sheet will volatilize completely and permeate the web stack being treated over a period of hours, days or weeks, the precise period being dependent on the vapour pressure of the amine salt, the temperature, the porosity of the cellulosic webs, and other such factors. Generally however, with CHC used as the amine salt, treatment will be complete within about 30 days or less.

The stack of cellulosic fibre webs treated according to the method of the present invention will particularly conveniently comprise the pages of a book or magazine or other bound document. The method of the invention can however be performed on unbound stacks, for example stacks of maps or loose papers, with the immobilizing agent serving to reduce amine vapour release to the surrounding atmosphere. Where the webs are bound however, the immobilizing agent will generally be disposed between the cover of the book or magazine and the source of the amine vapour.

The amine immobilizing agent may be any material capable of taking up or condensing the amine vapour, for example by absorption, by adsorption or by chemical reaction to form a non-volatile species which is not itself harmful to the books or papers or the like being treated. In one particularly preferred embodiment of the invention, the immobilizing agent is an absorbent particulate material, such as charcoal, graphite, amorphous carbon or soda lime, or mixtures thereof, especially mixtures of charcoal and soda lime, for example in the weight ratio 70:30 to 40:60, preferably 70:30 to 50:50, especially 65:35 to 55:45. As with the amine vapour source, the immobilizing agent may particularly conveniently be held within porous sachets or optionally within a porous sheet, for example within sachets of kraft paper. The sheet or sachet containing the immobilizing agent should preferably have surface dimensions comparable to those of the cellulosic webs being treated. The quantity of immobilizing agent that is required will of course vary according to the precise agent used; generally however a concentration of 700–1100 g/m$^2$ will be sufficient and for most common book sizes sachets or sheets containing 3 to 10, preferably 3 to 5, g of the immobilizing agent will be adequate.

Where the immobilizing agent is to be held within a sachet, compartmented sachets are again preferred so as to prevent the immobilizing agent from congregating entirely at one end of the sachet. Sachets having two, three or four compartments are particularly preferred.

Books in need of deacidification are frequently also damp and since cellulosic web deterioration is exacerbated by humidity, for the method of the invention it is particularly preferred to provide a desiccant in separate sachets or optionally in with the amine salt and/or in with the immobilizing agent. In this regard, drying agents such as silica gel and the highly absorbent starch-graft copolymers deserve particular mention. Such desiccants will conveniently be present at 10–30% relative to the weight of the amine salt or immobilizing agent.

As mentioned above, acidity within cellulosic fibre webs arises at least in part as a result of oxidation of atmospheric sulphur dioxide, a reaction which is catalysed by metal species present in small amounts in the cellulosic webs due to their manner of manufacture. Thus it will be appreciated that unless the cellulosic webs are kept in a sealed environment after deacidification, acidity may build up again. Accordingly, in the operation of the method of the invention it is preferred to permeate the cellulosic webs with an acid formation inhibitor, i.e. a substance which acts as catalyst poison, e.g. volatile inhibitors such as alpha-naphthol or other inhibitors such as those mentioned by Langwell in his publications (see for example The British Paper & Board Makers Association Inc., Technical Bulletin 1952, Vol. 29, parts 1 and 2, Technical Bulletin 1953, Vol. 30 No. 6 and Communication 1955, Vol. 36 part 1), for example hydroquinone and volatile phenolic compounds. Such catalyst poisons are believed to destroy catalytic activity by complexing with the metal species present in the cellulosic webs.

It is therefore preferred that such an acid formation inhibitor should be included in with the amine salt or, less preferably, in with the immobilizing agent. The inhibitor will preferably be included at up to about 5%, especially up to about 0.01%, relative to the weight of the amine salt.

Before use, sachets or impregnated sheets containing the immobilizing agent and the amine salt should of course be kept apart, conveniently in sealed plastics or foil containers, for example in polypropylene bags. For convenience sake, the sachets or impregnated sheets will preferably be packaged together in a pack suitable for the treatment of one or several volumes, preferably with instructions for the user included. Where the pack contains material sufficient for the treatment of several volumes, the sachets or sheets are preferably sealed in individual containers or in containers containing a small number, for example 2–20, especially 5–10, of sachets or sheets.

Viewed from a further aspect, the invention thus provides means for vapour phase deacidification of cellulosic fibre webs, said means comprising in combination at least one first porour web member, preferably in the form of a sachet, containing an amine salt and at least one second porous web member, again preferably in the form of a sachet, containing an amine immobilizing agent, and optionally, at least one third porous member, preferably in the form of a sachet, containing a desiccant, said first porous member preferably also containing an acid formation inhibitor and said first and second and, where present, said third, porous web members particularly preferably being packaged separately within vapour-tight containers.

Said means may further comprise at least one fourth porous member, preferably in the form of a sachet, containing a volatile fungicide, preferably a volatile organic fungicide.

Viewed from a still further aspect, the invention also provides cellulosic fibre web stacks deacidified by the method of the invention.

The present invention therefore presents an improved method of and means for vapour phase deacidification which overcome problems encountered with previous deacidification procedures and which, being extremely simple and non-laborious to use, are admirably suited to the needs of librarians, archivists and book retailers.

The present invention will now be illustrated further by the following non-limiting Examples.

EXAMPLE 1

Amin Salt Sachets

Each sachet, made of porous tea-bag paper (available from J. R. Crompton of Elton Paper Mills, Bury, Lancashire) of 42 g/m$^2$ weight, has two compartments of 12.5 cm by 7.5 cm dimension each containing 3 g of cyclohexylamine carbonate (available from B. G. Robertson Laboratories of Nursery Lane, Forest Gate, London E7), and 3 mg of alpha-naphthol (available from May and Baker of Dagenham, Essex). The sachets are packaged, in bundles of ten, in heat-sealed polypropylene bags.

Immobilizing Agent Sachets

Each sachet, made of porous kraft paper (a heat-sealable paper manufactured by Smith's of Whitehaven, Cumbria) of 59 g/m$^2$ weight has two compartments of dimension 7.5 cm by 8.5 cm each containing 5 g of powdered charcoal (available from Hill-Jones, Thomson Ltd of London). The charcoal is degassed and dried under vacuum before being filled into the sachets or after the sachets are filled, and the sachets are packaged, in pairs, in heat-sealed polypropylene bags.

EXAMPLE 2

A book of about 300 pages, some or all of which show an acid pH, has immobilizing agent-containing sachets inserted immediately inside the front and rear covers. Amine salt-containing sachets are inserted, at 50 page intervals, throughout the book. The book is then closed and returned to the shelf where it is left in an upright position for 30 days. Subsequent testing, for example using a page surface acidity detector, such as a an archivist pen (available from B. G. Robertson Laboratories, Nursery Lane, Forest Gate, London E7), will show deacidification to have been completed without further damage to the binding having occurred.

EXAMPLE 3

Books, some of all of the pages of which showed an acid pH, had 4–8 cyclohexylamine containing sachets inserted, at interals, throughout the books. The books were then placed inside a large bell jar together with pieces of pH paper. After 5 weeks the pages of the books were deacidified. However, the pH paper indicated the presence of an alkaline vapour and an ammoniacal odour was detectable inside the bell jar.

EXAMPLE 4

Books, some or all of the pages which showed an acid pH, has 4–8 cyclohexylamine sachets inserted, at intervals, throughout the books. Charcoal-containing sachets were inserted immediately inside the front and rear covers. The books were then held closed by elastic bands and were then placed inside a large bell jar together with pieces of pH paper. After 5 weeks the pages of the books were deacidified. The pH paper was unaffected and there was no detectable ammoniacal odour inside the bell jar.

I claim:

1. A method of preventing cellulosic fibre web degradation which method comprises permeating a stack of cellulosic fibre webs with an amine vapour so as to pass amine vapour through said stack, and disposing an amine-immobilizing agent to contact amine vapour which has passed through at least part of said stack, the immobilizing agent being in an amount sufficient to take up or condense excess amine vapour.

2. A method as claimed in claim 1 wherein said amine immobilising agent comprises an absorbent particulate material.

3. A method as claimed in claim 1 wherein as said amine immobilising agent is used carbon, soda lime or mixtures thereof.

4. A method as claimed in claim 3 wherein as said amine immobilising agent is used a 70:30 to 40:60 by weight mixture of charcoal and soda lime.

5. A method as claimed in claim 1 which comprises disposing at intervals within said stack porous web members containing an amine vapour emitter and at or adjacent the ends of said stack porous web members containing said amine immobilising agent.

6. A method as claimed in claim 1 which comprises disposing within said stack multicompartmented sachets containing an amine vapour emitter.

7. A method as claimed in claim 1 wherein an amine salt selected from acid salts of cyclohexylamine, diisopropylamine, di-n-butylamine and piperidine and mixtures thereof is disposed within said stack there to liberate said amine vapour.

8. A method as claimed in claim 1 wherein said stack is a book, magazine or bound document.

9. A method as claimed in claim 1 wherein said stack comprises unbound cellulosic sheets.

10. A method as claimed in claim 1 further comprising disposing within said stack a desiccant.

11. A method as claimed in claim 1 further comprising disposing within said stack a volatile fungicide.

12. A method as claimed in claim 1 further comprising disposing within said stack an acid formation inhibitor.

* * * * *